United States Patent [19]

Morrow

[11] Patent Number: 4,489,982

[45] Date of Patent: Dec. 25, 1984

[54] PELVIC SUPPORT METHOD AND MEANS

[75] Inventor: Winston G. Morrow, Lake Oswego, Oreg.

[73] Assignee: Spinal Dynamics, Inc., Lake Oswego, Oreg.

[21] Appl. No.: 537,822

[22] Filed: Sep. 30, 1983

Related U.S. Application Data

[63] Continuation of Ser. No. 210,212, Nov. 25, 1980.

[51] Int. Cl.[3] ..... A47C 7/02

[52] U.S. Cl. ..... 297/458; 297/460; 297/284

[58] Field of Search ..... 297/460, 458, 284, 452, 297/459, 457

[56] References Cited

U.S. PATENT DOCUMENTS

| | | | |
|---|---|---|---|
| 1,667,626 | 4/1928 | Epstein | 297/460 |
| 1,716,871 | 6/1929 | Weldon | 297/460 X |
| 1,917,264 | 7/1933 | Kellogg | 297/460 X |
| 2,139,028 | 12/1938 | Mensendicck et al. | 297/284 |
| 2,663,359 | 12/1953 | Wood | 297/460 |
| 3,288,525 | 11/1966 | Cerf | 297/284 |
| 3,512,835 | 5/1970 | Flototto | 297/457 |
| 3,642,319 | 2/1972 | Berchicci | 297/284 |
| 3,904,242 | 9/1975 | Koepke | 297/460 |
| 4,156,544 | 5/1979 | Swenson et al. | 297/284 |

FOREIGN PATENT DOCUMENTS

| | | |
|---|---|---|
| 1273761 | 7/1968 | Fed. Rep. of Germany . |
| 2418125 | 10/1975 | Fed. Rep. of Germany . |
| 210825 | 2/1967 | Sweden . |
| 140046 | 5/1930 | Switzerland . |

OTHER PUBLICATIONS

Contourpedic Backrest Cushion No. 0008.

*Primary Examiner*—Francis K. Zugel

*Attorney, Agent, or Firm*—Klarquist, Sparkman, Campbell, Leigh & Whinston

[57] ABSTRACT

A method and means for providing pelvic support to improve posture and relieve lower back pain is provided. The method comprises pressing a convex pillow against the region of the ilia, sacrum, and fifth lumbar vertebra to produce a substantial sacral base angle and to fully oppose any moment tending to cause rotational shifting of the pelvis. Another way to define the invention is a back pillow which may be used in a chair having a seat member, wherein the back pillow includes a convexly shaped support pillow for maintaining the pelvis of the user at a sufficient sacral base angle that substantially the entire weight of the upper portion of the user's body is supported by the seat member. The invention may alternatively be described as a chair comprising a substantially horizontal convex seat for supporting the ischial tuberosities of the occupant in the vicinity of the apex thereof, and a substantially vertical, generally convex support means for supporting the posterior portion of the occupant's pelvis at a sacral base angle of from between 25 and 45 degrees, and so that a gravitational line drawn downwardly from the center of L-3 intersects the anterior one-third of the sacral base.

9 Claims, 5 Drawing Figures

FIG. 5
PRIOR ART
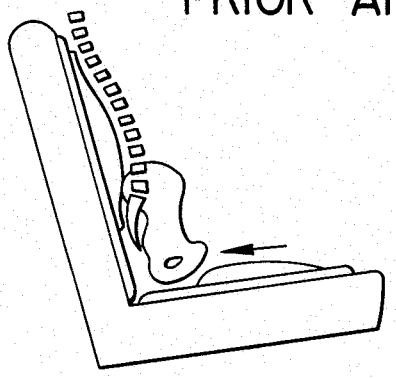
FIG. 3
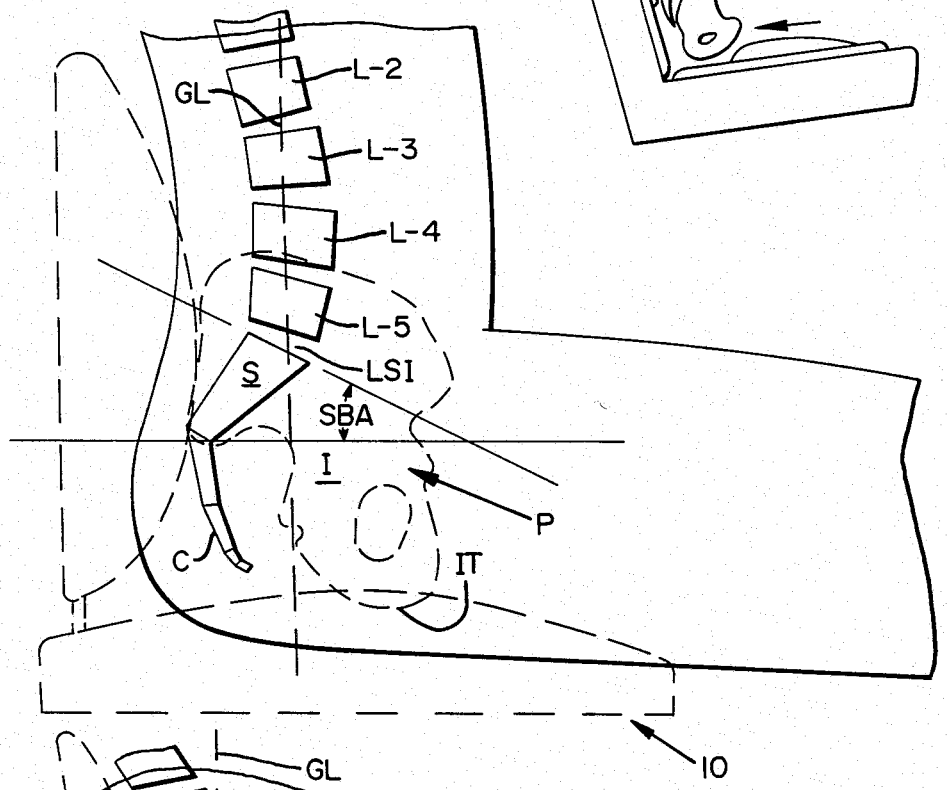
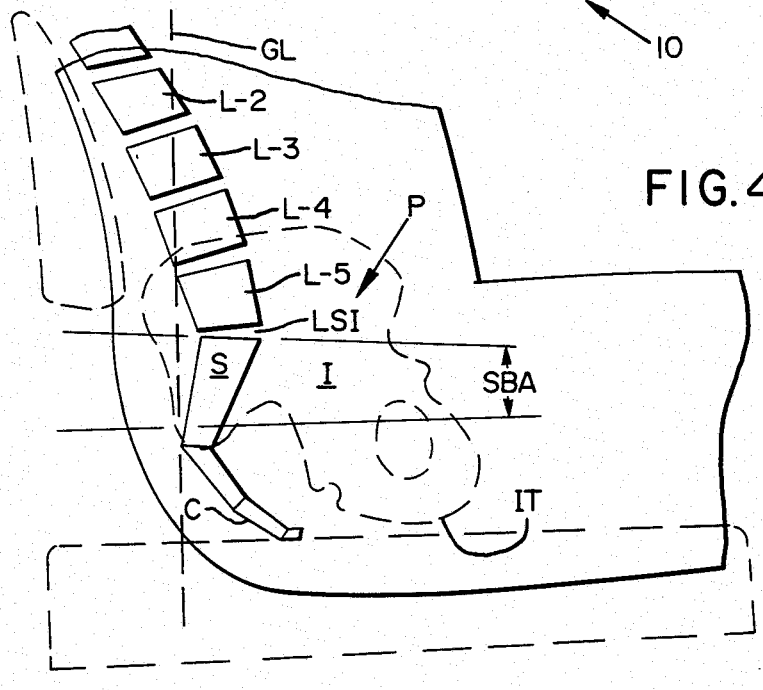
FIG. 4 PRIOR ART

PELVIC SUPPORT METHOD AND MEANS

This is a continuation of application Ser. No. 210,212, filed Nov. 25, 1980.

BACKGROUND AND SUMMARY OF THE INVENTION

This invention relates to a method and means for providing pelvic support to improve posture and relieve lower back pain.

Most so-called secretarial or working chairs include a substantially horizontal seat member and a substantially vertical back support member. This back support member is typically positioned substantially above the seat member, and is adapted to provide support to the small of the back or lumbar region of the occupant's spinal column. The typical lumbar support chair does not, however, support the pelvis of the occupant. Thus, as will be described in detail hereafter, the occupant's pelvis is permitted to shift posteriorly and inferiorly until the coccyx or tailbone contacts the seat of the chair. In order to counteract or prevent this shifting of the pelvis, the occupant must utilize muscles which are not intended for this purpose. The use of such muscles over an extended period results in fatigue and pain. It can also result in discomfort and damage to the lumbar vertebrae and the ligaments and tendons associated with such vertebrae, as will be described in detail below.

Thus, the present invention has as its objects any one or more of the following, either taken individually or in combination with one another:

(1) To provide a method and means for supporting the pelvis in order to promote proper posture and relieve lower back pain;

(2) To provide a secretarial or working chair which will provide comfort to the occupant even after extended periods of use;

(3) To provide pelvic support without the use of extraneous means which might restrict circulation of blood and/or lymphatic fluids to the lower extremities or result in discomfort to the occupant;

(4) To provide a pelvic support chair having a seat which is high enough from the floor that the femur heads of the occupant are inclined at a slightly downward angle when the occupant's feet are resting flat on the floor, thus not only promoting circulation to the lower extremities but also relaxing the hamstring muscles of the occupant;

(5) To provide a chair in which the ischial tuberosities of the occupant are positioned proximal the uppermost portion or apex of the seat pillow;

(6) To provide a back pillow which may be used either with a conventional chair or as a supine support to produce a substantial sacral base angle in the pelvis of the user and to fully oppose any moment tending to cause rotational shifting of the pelvis.

(7) To provide a combination of a seat pillow and back pillow which can be mounted to a conventional chair to provide appropriate pelvic support; and (8) To develop a chair which permits the occupant to achieve ligamentous posture, thereby reducing the amount of muscular and neurological exertion necessary to remain in an erect posture, and providing greater muscular control, tone, and strength for other activities undertaken while sitting in the chair; stated differently, this object is to keep the muscles of the body intact as determined by standard muscular tests.

This invention responds to the problems presented in the prior art by providing a back pillow for use in a chair having a generally horizontal seat member, wherein the back pillow includes convexly shaped support means for maintaining the pelvis of the user at a sufficient sacral base angle that substantially the entire weight of the upper portion of the body of the user is supported by the chair seat member. The term "pillow" is used herein not in the sense of a soft bed pillow, but in the sense of a common dictionary definition: "a block or support used especially to equalize or distribute pressure." The phrase "substantially the entire weight" is intended to distinguish those prior art designs which include a rearwardly tilting back adapted to support a certain portion of the weight of the occupant. Rather, it is intended to define a chair or a pillow to be used with a chair in which the pillow or chair back provides support primarily in a horizontal direction. The "upper portion of the body" is intended to define the pelvis and everything thereabove.

The invention may alternatively be described as a chair comprising a substantially horizontal, generally convex seat means for supporting the ischial tuberosities of the occupant in the vicinity of the apex thereof, in combination with substantially vertical, generally convex support means for supporting the posterior portion of the occupant's pelvis at a sacral base angle of from between 25 and 45 degrees, and so that a gravitational line drawn downwardly from the center of L-3 intersects the anterior one-third of the sacral base. Yet another way to describe the invention is the combination of seat and back pillows for use in a chair having a substantially horizontal seat member and a substantially vertical back member, wherein the seat pillow includes means for mounting the seat pillow to the seat member and has an upper surface with an apex, and wherein the back pillow includes means for mounting the back pillow to the back member and has means for supporting the pelvis of the occupant in a position such that a gravitational line drawn downwardly from the center of L-3 intersects the anterior one-third of the sacral base.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a fragmentary sectional side elevation view of the embodiment depicted in FIG. 1, showing the pertinent skeletal structure with the chair itself shown in phantom;

FIG. 4 is a fragmentary sectional side elevation view of a prior art lumbar-support chair showing the pertinent skeletal structure with the chair shown in phantom; and FIG. 5 is a copy of a side elevation sectional view shown in the Ackermann patent discussed hereinbelow, which includes a schematic depiction of the pertinent skeletal structure.

DETAILED DESCRIPTION OF THE PREFERRED EMBODIMENTS

Figures 1, 2:
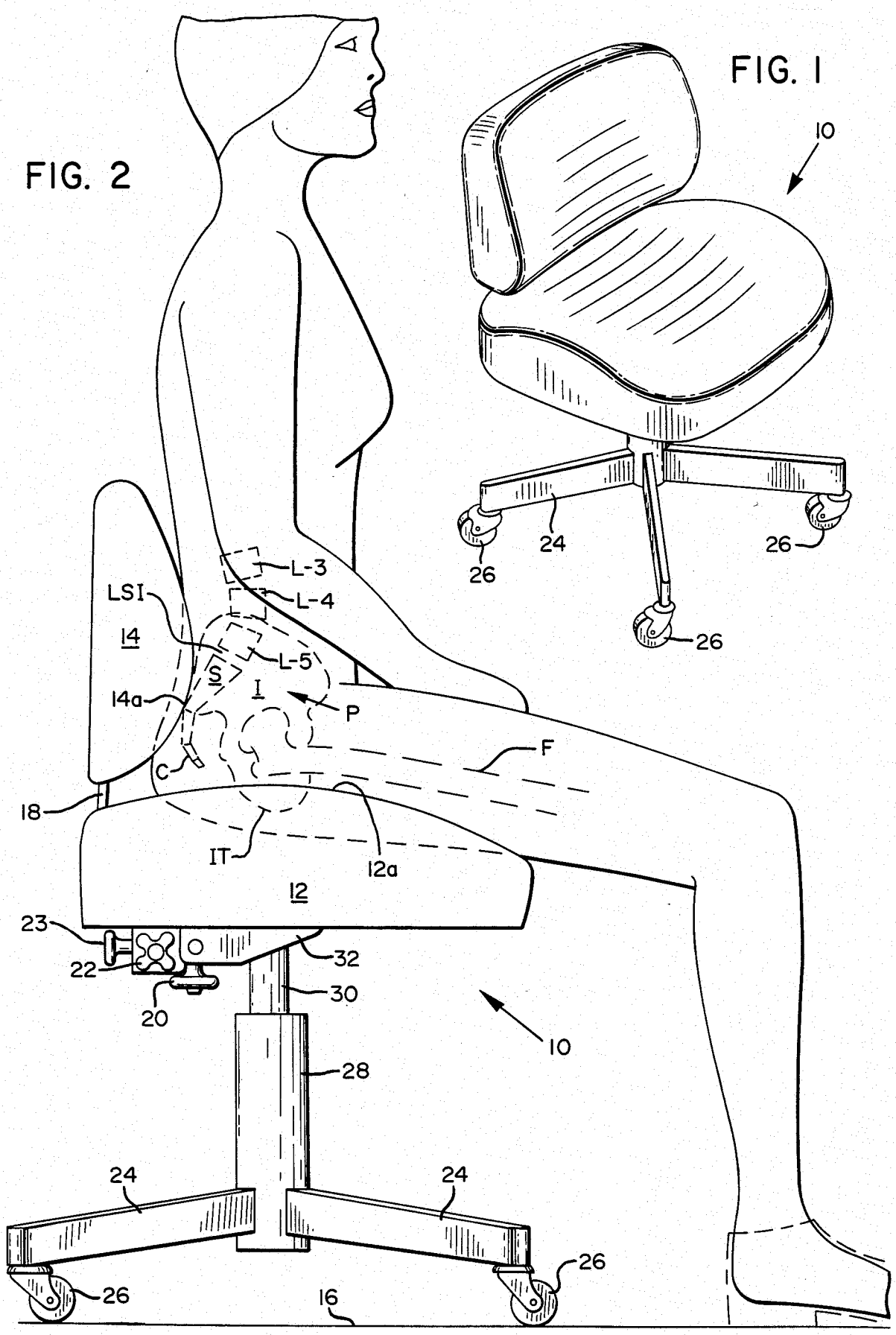
FIG. 1 is a perspective view of a chair which comprises one embodiment of the present invention.
FIG. 2 is a side elevation view of a person sitting in the chair of FIG. 1, wherein the most pertinent portions of the skeletal structure of such person are depicted in phantom.

The principles of this invention are particularly useful when embodied in a pelvic support chair such as that illustrated in FIGS. 1–3, generally indicated by the numeral 10. FIGS. 2–4 (and to some extent FIG. 5) schematically depict the pertinent skeletal components in phantom. The lumbar vertebrae are commonly designated L-1 through L-5, and are identified as such in the drawings. It can be seen that these vertebrae, along with those ligaments and tendons which hold them in place, define a forwardly convex curve. The sacrum S, in combination with the coccyx C, define a rearwardly convex curve positioned immediately below the lumbar curve. The sacrum S is centrally mounted to the ilia I by ligaments which provide a limited amount of movement therebetween. The so-called lumbosacral interspace (identified with the letters LSI) comprises the gap between the sacrum S and L-5. The relative movement between the sacrum S and L-5 at the lumbosacral interspace LSI is critical since the lumbosacral interspace LSI normally accounts for an estimated 75% of all lumbar flexion. Thus, unless support is provided to the pelvis, the inherent structural weakness of the spine produces the greatest kinetic strain potential at the lumbosacral interspace LSI.

The ilia I are sometimes referred to as the pelvic bone, although the term "pelvis" as used herein (designated with the letter P) is intended to define the region of the body which encompasses the ilia I and the sacrum S. The two laterally spaced, downwardly extending points at the bottom of the ilia I are termed the ischial tuberosities, and are designated with the letters IT. The importance of the position of the ischial tuberosities IT in the chair 10 vis-a-vis prior art chairs will become evident as this discussion continues.

In defining the position of the sacrum S, as well as the other elements of the pelvis P, the term "sacral base angle" will be utilized herein. This angle is defined between a line drawn across the superior base of the sacrum S, and the horizontal, as depicted in FIGS. 3 and 4 and identified with the letters SBA. A gravitational line GL drawn from the center of L-3 is also helpful to identify the position of the components of the pelvis. For this reason, line GL is shown in FIGS. 3 and 4.

FIG. 4 depicts the position of the pertinent skeletal components of a person sitting in a conventional lumbar-support chair. It can be seen that the back pillow in this chair merely provides support to the lumbar vertebrae and not to the pelvis P. The weight of the upper body on the posterior portions of the ilia I results in rotational shifting of the ilia I at the lumbosacral interspace LSI until the coccyx C of the person comes into contact with the seat pillow. As the pelvis P tilts posteriorly and inferiorly the sacral base angle SBA gets smaller. In the chair depicted in FIG. 4 the sacral base angle SBA is 3 degrees. At the same time, the gravitational line GL from L-3 moves posteriorly, increasing the moment on the ilia I. This rotation, which is in a counterclockwise direction as depicted in FIG. 4, causes a spastic flattening of the lumbar curve despite the presence of the back pillow. This, in turn, brings about alteration of the thoracic and cervical curves which further stresses the spinal musculature creating more fatigue and spasms. It also results in unlocking of the ligamentous joints of the spine and pelvis, thus causing stress to pelvic muscles which the person may utilize in an attempt to keep the pelvis in the proper position. This protracted muscular stress results in discomfort and strain due to fatigue. Additionally, irritation can arise from prolonged muscle spasms and, in the presence of disc degeneration among those persons with back problems, the spasms can constitute significant compressive force which can result in aberrant neuronal, vascular and lymphatic alteration. The effect of fatigue on concentration and productivity in the worker is obviously dramatic.

The need to support the pelvis is increased as the distance from the floor to the seat is decreased as is the case with automobile seats, deep sofas, and small school seat-desks where the legs of the occupant are extended. As the hamstrings elongate, they pull on the pelvis, thus exerting additional force, compounding the insult to the ligamentous and muscular support structures.

One attempt to avoid the aforedescribed problems with conventional lumbar support chairs is described in West German Pat. No. 1,273,761 issued to Ackermann. FIG. 5 is a copy of a drawing included in Ackermann's patent. In this patent Ackermann discloses a chair having a lumbar support cushion which extends downwardly sufficiently far to contact the posterior of the ilia. While Ackermann's drawing is not anatomically correct, it is clear that the back of his chair is rearwardly inclined so that the head of the occupant is substantially posterior of his or her pelvis. This results in a moment being applied about the pelvis. To prevent anterior slippage of the ischial tuberosities as a result of this moment, Ackermann utilizes a raised cushion positioned anteriorly of the ischial tuberosities. This raised cushion exerts a posterior force on the ischial tuberosities in the direction of the arrow, thereby locking them in place.

While Ackermann recognized the related problems of rotational shifting of the pelvis and restriction on circulation to the lower extremities, he went about solving these problems in the wrong way. In order for his raised cushion to be of any assistance in holding the ischial tuberosities in place, it must be of substantial size. However, this would inherently result in localized pressure on the posterior surface of the thighs, thereby restricting circulation of blood and lymphatic fluids to the lower extremities. If the raised cushion is reduced in size to promote circulation, it would be too small to provide support to the ischial tuberosities.

A second drawing in the Ackermann patent discloses the use of firm plates covered with soft padding which is compressed by the weight of the pelvic bones. For this reason, the pelvis of the occupant could not be supported by the padding.

A Swiss patent to Garrett discloses a backrest having adjustable back support means. However, this patent is even less pertinent than the Ackermann German patent.

The present invention overcomes these problems by providing a chair 10 comprised essentially of a substantially horizontal seat pillow 12 and a substantially vertical back pillow 14. Both seat and back pillows 12 and 14 are of generally convex configuration. The term "convex" as used herein is intended to define any outwardly curved surface. The surface need not be symmetrical in any way. The pillows 12 and 14 of chair 10 are preferably made up of resilient material having substantially the same degree of firmness. This firmness is ordinarily in the range of 70–80 ILD. An 80 ILD pillow, for example, exhibits a one inch deflection under an 80 pound load applied over a one square foot area. This, incidentally, is a far greater firmness value than most conventional chair pillows.

Seat pillow 12 is relatively short in length and is downwardly sloping toward the front in order to force the occupant to sit back into chair 10 so that the ischial tuberosities IT are positioned proximal the apex 12*a* of the convexly curved seat pillow. A person sitting in this or any other chair cannot slouch unless the posterior portion of the pelvis P first shifts posteriorly and inferiorly. This pelvic movement is possible in the conventional lumbar support chair, but is not possible in chair 10 because the back pillow 14 contacts the posterior of pelvis P, thereby supporting same. For this reason, back pillow 14 is sometimes referred to as pelvic support means. More precisely, it can be seen that the apex 14*a* of the convexly curved back pillow 14 contacts the ilia I, the sacrum S, and in some instances, L-5. The word "contacts" as used herein, of course, merely means that back pillow 14 touches the skin and the fleshy portions of the body immediately behind the ilia I, sacrum S, and L-5. Thus, the only way for the pelvis P to shift to a slouching position is for the ischial tuberosities IT to slide anteriorly and inferiorly down the seat pillow 12. However, due to the short down-sloping configuration of seat pillow 12, such movement of the ischial tuberosities IT would tend to cause the occupant to actually slide out of the chair 10. Thus, by inducing the occupant to sit all the way back with the ischial tuberosities proximal apex 12*a*, rotational shifting of the pelvis P and the slouching made possible by such movement of the pelvis P is effectively discouraged.

The fact that the seat pillow 12 is short and downwardly sloping also serves to reduce any possible restriction upon circulation to the lower extremities, not only due to the lack of any members which would cause localized pressure points on the posterior surfaces of the thighs, but also because the femur heads F are slightly downwardly inclined. In order to provide for this downward inclination, the height of the seat pillow 12 above the floor 16 should be adjusted properly, as will be described hereafter.

In the depicted preferred embodiment, the thickness of back pillow 14 increases toward its bottom edge. Another way to describe this configuration is to say that the apex 14*a* of the convex curvature of back pillow 14 is positioned below the transverse centerline thereof. It should be appreciated, however, that various configurations in back pillow 14 may be utilized, as long as the proper support is provided to the pelvis P of the user.

It can be seen that back pillow 14 supports the pelvis P in a generally upright position, which results in a sacral base angle SBA of from between 25 to 45 degrees. This approximates the sacral base angle SBA when an average person is in an erect, physiologic, standing position. In the depicted embodiment, the sacral base angle SBA equals 27 degrees, which is within the normal range of ligamentous posture. The term "ligamentous" as it relates to posture is used herein to mean that physiologic posture which permits the joints of the body to rely upon their surrounding ligaments for support, requiring only intermittent, minor muscular contractions triggered by the reflexes of the joints and ligaments; that is, substantial, continuous muscular effort is not required when ligamentous posture has been achieved.

The gravitational line from L-3 provides a second, and perhaps an even better, indication of whether ligamentous posture has been achieved. A close study of FIG. 3 reveals that the gravitational line GL from L-3 intersects the anterior one-third of the sacral base. When this occurs, the pelvis P is in a ligamentous position. When line GL does not intersect the anterior one-third of the sacral base, such as in the prior art design of FIG. 4, then unlocking of the ligamentous joints results, and muscular effort is necessitated.

With the pelvis P supported in the depicted physiologic position, the lumbosacral interspace LSI is firmly held in position, thereby limiting the amount of movement between the sacrum S and L-5. This is an important feature of the invention, because, as mentioned above, the lumbosacral interspace LSI accounts for as much as 75% of all lumbar flexion. In this physiologic pelvic position, the spine is also physiologic, erect and static, requiring minimum muscular effort on the part of the occupant of the chair. It should be appreciated that this low degree of muscular effort is made possible because physiologic erect balance is essentially a ligamentous function. Such ligamentous posture is, as mentioned above, effortless and therefore non-fatiguing. This feature of the invention would clearly be of great importance to persons in sedentary occupations who spend long hours or perhaps the entire work day in a chair.

As shown in FIG. 2, back pillow 14 is mounted to seat pillow 12 by support member 18 which extends therebetween. As depicted, this typically positions back pillow 14 posteriorly of the apex 12*a* of seat pillow 12. It may be desirable to certain applications that there be a certain amount of flexion between back pillow 14 and seat pillow 12. For this purpose, the chair 10 includes a first control knob 20 which, through appropriate springs and linkages, controls the degree of flexion between support member 18 and seat pillow 12 mounted thereto. Normally, it is desirable that only a limited amount of flexion be provided in order to ensure proper and sufficient pelvic support. A second control knob 22 may also be provided adjacent the sub-frame 32 of chair 10 in order to provide for vertical adjustability of support member 18 and back pillow 14 carried thereby. Again, only a limited amount of adjustability need be provided, since the anatomical differences in the heights of the pelvises of various persons is not that substantial. A third control knob 23 is normally also provided, mounted adjacent sub-frame 32 to permit support member 18 and back pillow 14 mounted thereto to be adjusted posteriorly and anteriorly to accommodate persons of widely varying weight and build. Since all three of these adjustability features are of conventional design, they have not been depicted in detail, nor will they be described furthur.

The base of the depicted chair 10 includes a plurality of evenly spaced, radially extending support spokes 24 having wheels 26 mounted at the ends thereof. These support spokes 24 are mounted to a centrally disposed post 28. A height-adjustment member 30 extends upwardly from post 28 to the sub-frame 32 of seat pillow 12. This height-adjustment member 30 is threaded into post 28 so that by rotating seat pillow 12 with respect to post 28 and support spokes 24, the height of seat pillow 12 with respect to the floor 16 may be varied. As mentioned above, the adjustability of the height of seat pillow 12 with respect to the floor 16 is desirable in order to permit the chair 10 to be specifically adjusted to the individual occupant. When the occupant is in the chair, his or her feet should be permitted to rest flat on the floor 16. With the feet in this position, femur heads F should be in a slightly downwardly inclined position, as shown in FIG. 2. With the occupant positioned thusly, the ischial tuberosities IT rest proximal the apex 12*a* of seat pillow 12 which is substantially centered over post 28.

The position of the pelvis P may be described in another way if reference is made to FIG. 3. This figure shows that the gravitational line GL drawn from L-3 intersects seat pillow 12 immediately to the posterior, but still in the general vicinity of the apex 12*a* thereof. Under some conditions it may be desirable to provide a substantially horizontal apex plane (not shown) extending immediately posteriorly of the depicted apex 12*a*. With this configuration of seat pillow, line GL would intersect this apex plane.

The stability of the depicted chair is ensured by the fact that, first, L-3 and the upper portion of the body generally are positioned substantially over apex 12*a*, and, second, apex 12*a* is centrally disposed over post 28. This stability is enhanced by the fact that there is tripod support between the chair and the two feet of the occupant. Moreover, since the feet are resting on the floor, thus carrying the weight of the lower extremities, there is virtually no restriction of circulation to the lower extremities which could result if the feet where held in an elevated position by seat pillow 12. This manner of positioning the occupant in a tripod fashion has the additional advantage of making it extremely easy for the occupant to get up out of the chair. While in the chair, the occupant has great mobility since the feet may be easily utilized to swing the chair 10 around in a circle, or to roll it across the floor 16.

In view of the broad definition of "pillow" used herein, it is clear that the principles of the invention may also be applied to rigid chairs and seats, such as folding chairs, school seats, vehicle seats, church pews, and auditorium and stadium seats.

Under certain conditions, it may be desirable to provide a removable back pillow (not shown) which could be adapted to be positioned on a conventional chair. Like the depicted back pillow 14, this removable pillow would usually be convexly shaped in order to maintain the pelvis of the user at a sufficient sacral base angle that substantially the entire weight of the upper portion of the user's body is supported by the chair seat member. Stated another way, the removable back pillow may be said to include support means for producing a substantial sacral base angle in the pelvis of the user, and to fully oppose any moment tending to cause rotational shifting of the pelvis. The term "substantial sacral base angle" is intended to cover an angle of at least 25 degrees.

This removable pillow may also be placed in the appropriate position under a person's back when that person is in the supine position, thus encouraging a ligamentous pelvic position and lumbar curvature. Without such support, the pelvis has a tendency to shift rotationally in a posterior direction, carrying with it the lumbar vertebrae, much as described above.

Of course, it should be understood that various changes and modifications of the preferred embodiments described herein will be apparent to those skilled in the art. Such changes and modifications can be made without departing from the spirit and scope of the present invention and without diminishing its attended advantages. It is, therefore, intended that such changes and modifications be covered by the following claims.

I claim:

1. A method of seating a person to achieve ligamentous posture, comprising seating the person on a substantially horizontal upwardly convex resilient seat means having an apex extending across the width thereof with the ischial tuberosities positioned proximal the apex thereof, adjusting the seat means to a height such that the person's feet rest flat on the floor, the seat means being sufficiently short and firm such that the person's femur heads are slightly downwardly inclined in the forward direction; and supporting the posterior portion of the person's pelvis by providing on the seat means a back support pressing a forwardly convex pillow against the region immediately behind and at the elevation of the person's ilia and sacrum and allowing the person's back to be substantially unsupported in the lumbar region, thereby to produce a substantial sacral base angle and prevent rotational shifting of the pelvis.

2. The method of claim 1 wherein the sacral base angle is between 25 and 45 degrees.

3. A chair for an occupant of predetermined size, comprising:

substantially horizontal, upwardly convex seat means having an apex extending across the width thereof; and substantially vertical, forwardly convex back support means, the back support means being positioned relative to the seat means to contact and support the posterior portion of the occupant's pelvis when the occupant is seated on the seat means with the ischial tuberosities positioned proximal the apex thereof, the back support allowing the occupant's back to be substantially unsupported in the lumbar region, the seat means being adjustable to a height above the floor so that when the occupant is seated on the seat means with the ischial tuberosities positioned proximal the apex thereof, the feet of the occupant rest flat on the floor, the seat means being sufficiently short and firm such that when the occupant is so seated, the femur heads are slightly downwardly inclined in the forward direction.

4. The chair of claim 3 wherein the seat means comprise resilient material having a firmness of between about 70 and 80 ILD.

5. The chair of claim 3 wherein the seat means comprises a convex seat pillow.

6. The chair of claim 3, further comprising support means for the seat means, said support means being positioned immediately below the apex of the seat means.

7. The chair of claim 3 wherein the back support means comprise resilient material having a firmness of between about 70 and 80 ILD.

8. The chair of claim 3 wherein the back support means comprises a convex back pillow, the thickness of the pillow increasing toward its lower edge whereby the apex of its convex curvature is positioned below the transverse centerline thereof.

9. The chair of claim 8 wherein an upper portion of the convex surface of said pillow slopes rearwardly from the apex thereof.

* * * * *